US010562306B2

(12) United States Patent
Yaginuma et al.

(10) Patent No.: US 10,562,306 B2
(45) Date of Patent: Feb. 18, 2020

(54) METHOD OF MANUFACTURING LIQUID EJECTION HEAD

(71) Applicant: CANON KABUSHIKI KAISHA, Tokyo (JP)

(72) Inventors: Seiichiro Yaginuma, Kawasaki (JP); Koji Sasaki, Nagareyama (JP); Kazuhiro Asai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/005,958

(22) Filed: Jun. 12, 2018

(65) Prior Publication Data

US 2018/0361747 A1 Dec. 20, 2018

(30) Foreign Application Priority Data

Jun. 19, 2017 (JP) ..... 2017-119876

(51) Int. Cl.
*B41J 2/16* (2006.01)

(52) U.S. Cl.
CPC ..... *B41J 2/1639* (2013.01); *B41J 2/1623* (2013.01); *B41J 2/1628* (2013.01); *B41J 2/1629* (2013.01); *B41J 2/1631* (2013.01); *B41J 2/1634* (2013.01); *B41J 2/1642* (2013.01); *B41J 2/1645* (2013.01)

(58) Field of Classification Search
CPC ..... B41J 2/1639; B41J 2/1629; B41J 2/1628; B41J 2/1642; B41J 2/1623; B41J 2/1645; B41J 2/1631; B41J 2/1634
See application file for complete search history.

(56) References Cited

U.S. PATENT DOCUMENTS

| | | | | |
|---|---|---|---|---|
| 7,513,601 | B2 | 4/2009 | Asai et al. | |
| 7,629,111 | B2 | 12/2009 | Kubota et al. | |
| 8,017,307 | B2 | 9/2011 | Kubota et al. | |
| 8,227,043 | B2 | 7/2012 | Kubota et al. | |
| 8,956,703 | B2 | 2/2015 | Asai et al. | |
| 9,421,773 | B2 | 8/2016 | Asai et al. | |
| 2010/0216264 | A1* | 8/2010 | Matsumoto | B41J 2/1603 438/21 |
| 2011/0018938 | A1 | 1/2011 | Rivas et al. | |
| 2014/0132674 | A1* | 5/2014 | Takeuchi | B41J 2/14072 347/47 |
| 2016/0271949 | A1 | 9/2016 | Yamamuro et al. | |

* cited by examiner

*Primary Examiner* — Duy Vu N Deo
(74) *Attorney, Agent, or Firm* — Venable LLP

(57) ABSTRACT

A liquid ejection head is manufactured by covering a mold material arranged on a patterned protecting layer on a substrate and subsequently removing the mold material to produce a flow path. A sacrificial layer employed as the mold material operates as mask for patterning the protecting layer.

16 Claims, 6 Drawing Sheets

METHOD OF MANUFACTURING LIQUID EJECTION HEAD

BACKGROUND OF THE INVENTION

Field of the Invention

The present invention relates to a method of manufacturing a liquid ejection head.

Description of the Related Art

Liquid ejection heads are being employed in liquid ejection apparatus such as inkjet recording apparatus. They show a structure of having a substrate in which ejection energy generating elements and drive circuits for driving them are arranged and a flow path for supplying liquid to be ejected is formed on the surface of the substrate. Normally, a protecting layer is formed on the substrate of the liquid ejection head for the purpose of protecting the ejection energy generating elements and the drive circuits or the substrate itself from liquid. For example, the specification of U.S. Patent Application Publication No. 2011/0018938 describes forming a protecting layer on the entire surface of the substrate of a liquid ejection head.

When forming a protecting layer as described in U.S. Patent Application Publication No. 2011/0018938 on a substrate and, after patterning the protecting layer, arranging a flow path forming member to form a flow path on the protecting layer, the accuracy of the positional relationship between the protecting layer and the flow path forming member can give rise to a problem. For example, if the flow path forming member and the patterned protecting layer are positionally misaligned and part of the surface of the substrate that is not covered by the protecting layer is exposed to the flow path, it is no longer possible to provide the exposed part with a protecting feature of the protecting layer. In other words, the degree of accuracy of the positional alignment of the patterned protecting layer and the flow path forming member needs to be improved to improve the quality of the produced liquid ejection head.

SUMMARY OF THE INVENTION

According to the present invention, there is provided a method of manufacturing a liquid ejection head comprising a substrate having a surface provided with energy generating elements for ejecting liquid and a flow path forming member coupled with the substrate to form a flow path on the surface so as to eject liquid supplied to the flow path by means of energy generated by the energy generating elements, a protecting layer being arranged on a part of the surface exposed to the flow path, the method comprising: a protecting layer forming step of forming a protecting layer in a region of the surface including the part thereof exposed to the flow path; a sacrificial layer forming step of forming a sacrificial layer operating as a mold material for the flow path on the protecting layer; a patterning step of patterning the protecting layer, using the sacrificial layer as mask; a sacrificial layer coating step of coating the sacrificial layer with a material for forming the flow path forming member; and a flow path forming step of forming a flow path by removing the sacrificial layer.

Further features of the present invention will become apparent from the following description of exemplary embodiments with reference to the attached drawings.

DESCRIPTION OF THE EMBODIMENTS

Figure 1:
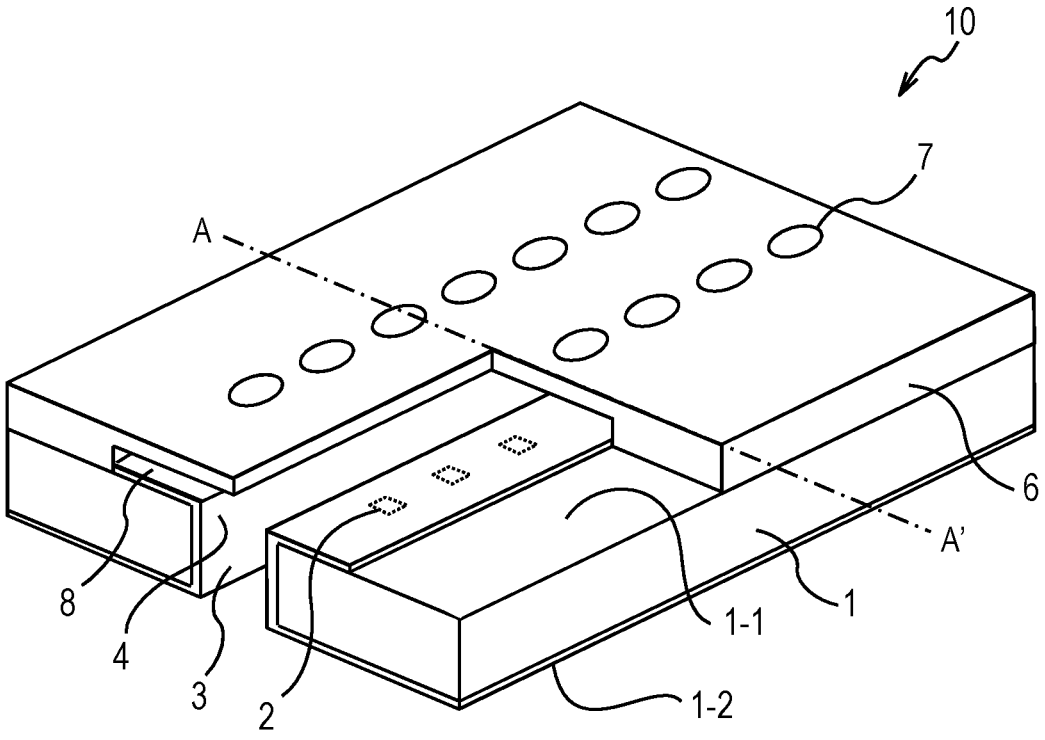
FIG. 1 is a schematic illustration of an exemplar liquid ejection head.

When forming a protecting layer on the entire surface of a substrate including the part thereof for forming a flow path and ejection ports as described in U.S. Patent Application Publication No. 2011/0018938, problems as listed below can arise depending on the liquid wettability of the protecting layer relative to liquid and/or the adhesion between the protecting layer and the flow path forming member.

(1) The flow resistance of liquid can change when a protecting layer becomes existent on the flow path.

(2) As the wettability relative to liquid changes at and near the ejection ports, liquid residues can adhere to and near the ejection ports to adversely affect the ejection characteristics of the ejection ports and/or the cleaning performance of the operation of cleaning off the liquid at and near the ejection ports by means of a wiper.

(3) When the adhesion between the protecting layer and the flow path forming member is weak, the protecting layer can come off to adversely affect the quality and the service life of the protecting layer and the entire liquid ejection head.

(4) If a liquid ejection head is shipped with a protecting tape or some other protecting member applied to the liquid ejection head and the adhesion between the protecting layer and the protecting member is too strong, the product can be damaged when the protecting member is removed, (5) When a functional film is formed on the uppermost surfaces of the energy generating elements as anti-scorching measure or anti-cavitation measure, the material selecting process for making the functional film and the protecting layer that covers the entire surface compatible with each other can become a difficult one.

Thus, there can be instances where a protecting layer is preferably formed not on the entire surface of the substrate but only partly on the surface of the substrate. Additionally, there can also be instances where it is difficult to make the functional film and the protecting layer compatible with each other when a flow path forming member and ejection ports are formed after forming a protecting layer on the entire surface of the substrate. Furthermore, there can also be instances where it is difficult to secure the tight adhesion between the protecting layer and the flow path forming member. In any of such instances, a protecting layer is preferably formed only partly on the substrate surface.

Therefore, the present invention is made to achieve an object of providing a method of manufacturing a liquid ejection head that can improve the accuracy of positional alignment of a patterned protecting layer and a flow path forming member on a substrate and thereby improve the quality of the manufactured liquid ejection head when a protecting layer is formed only partly on the substrate surface.

A liquid ejection head that is manufactured by the method of the present invention includes a substrate having on the surface thereof energy generating elements for ejecting liquid and a flow path forming member for forming a flow path on the substrate surface so as to eject the liquid supplied to the flow path from ejection ports by means of the energy generated by the energy generating elements, a protecting layer being arranged at least on the part of the substrate surface exposed to the flow path.

A method of manufacturing a liquid ejection head according to the present invention includes:

(A) a protecting layer forming step of forming a protecting layer in a region of the substrate surface including the part thereof exposed to the flow paths;

(B) a sacrificial layer forming step of forming a sacrificial layer operating as the mold material for the flow path on the protecting layer formed on the substrate surface;

(C) a patterning step of patterning the protecting layer, using the sacrificial layer as mask;

(D) a sacrificial layer coating step of coating the sacrificial layer with the material for forming the flow path forming member; and (E) a flow path forming step of forming a flow path by removing the sacrificial layer.

The sacrificial layer is removed preferably by way of the liquid supply path that runs through the substrate in the thickness direction of the substrate. In other words, a method of manufacturing a liquid ejection head according to the present invention can include step (F) as described below in addition to the above-described steps.

(F) a liquid supply path forming step of forming a liquid supply path running through the substrate in the thickness direction of the substrate and communicating with the flow path. The liquid supply path forming step (F) may be executed after the sacrificial layer coating step (D) or before the protecting layer forming step (A).

When the liquid supply path forming step (F) is executed after the sacrificial layer coating step (D), the liquid supply path is formed so as to get to the sacrificial layer in the liquid supply path forming step (F).

When, on the other hand, the liquid supply path forming step (F) is executed before the protecting layer forming step (A), a protecting layer can additionally be formed in the protecting layer forming step on the inner walls of the liquid supply path and/or on the rear surface of the substrate that is opposite to the surface thereof where the flow path is to be formed.

The substrate to be used has a first surface and a second surface that is the back surface opposite to the first surface and ejection ports may be formed either on the first surface or on the second surface of the substrate. Then, the flow path forming operation in the above-described steps (A) through (E) may be executed on the first surface and/or the second surface and the timing of executing the liquid supply path forming step can be selected according to the surface on which the flow path is formed.

A liquid ejection head having a flow path both on the first surface and on the second surface, which is the rear surface relative to the first surface, can include the components listed below.

(a) a substrate having energy generating elements to be used for ejecting liquid, (b) a flow path forming member having the first flow path arranged on the first surface, (c) a flow path forming member having the second flow paths arranged on the second surface, (d) a liquid supply path running through the substrate from the first surface to the second surface and holding the first flow path and the second flow path in communication with each other, (e) a protecting layer formed on the part of the first surface exposed to the first flow path, on the part of the second surface exposed to the second flow path and on the inner walls of the liquid supply path and (f) ejection ports for ejecting the liquid supplied by way of the first flow path, the second flow path and the liquid supply path by means of the energy from the energy generating elements.

A method of manufacturing a liquid ejection head having the above-described configuration can include a first flow path forming step of forming the first flow path and a second flow path forming step of forming the second flow path. The flow path forming technique using the above-described steps of (A) through (E) can be utilized for the first flow path forming step and the second flow path forming step.

The first flow path forming step and the second flow path forming step may be used in combination in either of the two modes of combination that are described below.

(First Mode of Combination of the First Flow Path Forming Step and the Second Flow Path Forming Step)

The first flow path forming step and the second flow path forming step in the first mode of combination respectively include the sub-steps that are listed below.

First Flow Path Forming Sub-Steps:

(1-1) a protecting layer forming step of forming a protecting layer on the first surface of the substrate (1-2) a sacrificial layer forming step of forming a first sacrificial layer that operates as the mold material for the first flow path on the protecting layer formed on the first surface (1-3) a patterning step of patterning the protecting layer, using the first sacrificial layer as mask (1-4) a sacrificial layer coating step of coating the first sacrificial layer with the flow path forming member (1-5) a liquid supply path forming step of forming a liquid supply path that runs through the substrate from the first surface to the second surface and gets to the first sacrificial layer (1-6) a flow path forming step of forming a flow path by removing the first sacrificial layer by way of the liquid supply path Second Flow Path Forming Sub-Steps:

(2-1) a protecting layer forming step of arranging a protecting layer on the inner wall surfaces of the liquid supply path and on the second surface of the substrate (2-2) a sacrificial layer forming step of forming a second sacrificial layer that operates as the mold material for the second flow path on the protecting layer formed on the second surface (2-3) a patterning step of patterning the protecting layer, using the second sacrificial layer as mask (2-4) a sacrificial layer coating step of coating the second sacrificial layer with the flow path forming member (2-5) a flow path forming step of forming a second flow path by removing the second sacrificial layer (Second Mode of Combination of the First Flow Path Forming Step and the Second Flow Path Forming Step)

The first flow path forming step and the second flow path forming step in the second mode of combination respectively includes the sub-steps that are listed below.

First Flow Path Forming Sub-Steps:

(I-1) a liquid supply path forming step of forming a liquid supply path that runs through the substrate from the first surface to the second surface at a position where the liquid supply path communicates with the first flow path and the second flow path of the substrate (I-2) a protecting layer forming step of forming a protecting layer on the first surface and the second surface of the substrate and on the inner wall surfaces of the liquid supply path (I-3) a sacrificial layer forming step of forming a first sacrificial layer that operates as the mold material for the first flow path on the protecting layer formed on the first surface of the substrate (I-4) a patterning step of patterning the protecting layer on the first surface of the substrate, using the first sacrificial layer as mask (I-5) a sacrificial layer coating step of coating the first sacrificial layer with the flow path forming member (I-6) a flow path forming step of forming a first flow path by removing the first sacrificial layer by way of the liquid supply path Second Flow Path Forming Sub-Steps (II-1) a sacrificial layer forming step of forming a second sacrificial layer that operates as the mold material for the second flow path on the protecting layer formed on the second surface of the substrate (II-2) a patterning step of patterning the protecting layer on the second surface of the substrate, using the second sacrificial layer as mask (II-4) a sacrificial layer coating step of coating the second sacrificial layer with the flow path forming member (II-5) a flow path forming step of forming a second flow path by removing the second sacrificial layer In an instance where flow paths are formed both on the first surface and on the second surface of the substrate, ejection ports may be formed either at the first surface side or at the second surface side of the substrate. Both the first sacrificial layer and the second sacrificial layer may be formed by means of dry film.

In each of the above-described methods of manufacturing a liquid ejection head according to the present invention, a protecting layer may be formed entirely on the parts of the substrate surface that are exposed to the flow path or selectively only on the parts of the substrate surface that are exposed to the flow path and require protection. Additionally, if necessary, a protecting layer may be formed on parts of the substrate surface other than the parts thereof that are exposed to the flow path. Furthermore, a sacrificial layer may be arranged on the protecting layer for the part thereof that requires protection other than the flow path forming region on the substrate surface in addition to the sacrificial layer to be utilized as the mold material for the flow path.

Now, embodiments of the present invention will be described below by referring to the accompanying drawings. Note, however, that the present invention is by no means limited to the materials, the structures and the manufacturing methods that are described hereinafter.

FIG. 1 is a schematic illustration of an exemplar liquid ejection head that can be manufactured by a manufacturing method according to the present invention.

The liquid ejection head 10 shown in FIG. 1 includes a substrate 1 and a flow path forming member 6 arranged on the first surface 1-1 of the substrate 1. The flow path forming member 6 is provided with ejection ports 7. A flow path 8 is formed by the flow path forming member 6 and the substrate 1.

Energy generating elements 2 for generating energy necessary to eject liquid are arranged at the side of the first surface 1-1 of the substrate. The energy generated by the energy generation elements 2 act on the liquid in the flow path 8 and liquid is ejected from the ejection ports 7 that are held in communication with the flow path 8.

A liquid supply path 3 that runs through the substrate 1 from the first surface 1-1 to the second surface 1-2, which is the rear surface of the substrate relative to the first surface 1-1, and communicates with the flow path 8 is arranged in the substrate 1.

Protecting layer 4 is arranged at least on the parts of the first surface 1-1 that are exposed to the flow path 8. In the illustrated instance, the protecting layer 4 is formed on the inner wall surfaces of the through hole for forming the liquid supply path 3 and on the second surface 1-2 of the substrate 1 in addition to the parts of the first surface 1-1 of the substrate 1 that are exposed to the flow path 8 as a continuous layer.

The substrate 1 is not subject to any particular limitations so long as it can be utilized for a liquid ejection head, although a substrate in and on which semiconductor elements such as transistors and circuits can be formed is preferable. Examples of materials that can be used to form such a substrate include metals and alloys such as Si, Ge, SiC, GaAs, InAs and GaP, diamond, oxide semiconductors such as ZnO, nitride semiconductors such as InN and GaN, mixtures of two or more such semiconductors and organic semiconductors. Additionally, a substrate that is made of glass, $Al_2O_3$, resin or metal and in which one or more circuits are formed by using one or more thin film transistors, an SOI substrate or a substrate prepared by bonding metal to a resin-made base member may be used for the substrate 1. Of the above-listed ones, a silicon substrate may preferably be employed for the substrate 1.

Circuits (not shown) for driving the energy generating elements 2 and connection terminals (not shown) can be formed in and/or on the substrate 1. Any known elements can be used for the energy generating elements 2. Examples of elements that can be used for the energy generating elements 2 include heating resistor elements made of TaSiN or the like and designed to use thermal energy, electromagnetic wave heating elements, piezoelectric elements designed to use mechanical energy, ultrasonic wave elements and elements designed to eject liquid by means electric energy or magnetic energy. The energy generating elements 2 may be held in contact with the surfaces of the substrate 1 or may be formed so as to be partly suspended in air. The energy generating elements 2 may be covered by an insulating layer or a protecting layer.

For forming the protecting layer 4, a material that can be subjected to a patterning operation in the patterning step, which will be described in greater detail hereinafter, can be selected out of known materials that can be used for protecting the substrate of a liquid ejection head and materials that can be used for protecting layers.

The material for forming the flow path forming member 6 is not subject to any particular limitations. Any material selected from known materials to be used for forming flow paths and materials that can be utilized for flow path forming members may be used to form the flow path forming member of the liquid ejection head.

The protecting layer 4 and the flow path forming member 6 may be made of the same material or respective materials that are different from each other. When the protecting layer 4 and the flow path forming member 6 are formed by means of one or two resin materials such as one or two photosensitive resin materials, they may be either negative-type photosensitive resin or positive-type photosensitive resin, although they are preferably formed from negative-type photosensitive resin. Examples of negative-type photosensitive resin that can be used for the protecting layer 4 and the flow path forming member 6 include epoxy resin. As commercially available resin, for example, EHPE-3150 (trade name, available from Daicel Corporation) may be used. A single type photosensitive resin may be used or, alternatively, two or more types of photosensitive resin may be used in combination. When the degree of freedom of the manufacturing steps, the reliability of the product and other factors are taken into consideration, the resin to be used preferably shows a high degree of resistivity relative to heat and chemicals. Thus, the resin to be used is preferably at least one selected from polyimide resin, polyamide resin, epoxy resin, polycarbonate resin, acrylic resin and fluorine resin. Of the above-listed ones, the use of epoxy resin is highly preferable.

The photosensitive resin to be used for the purpose of the present invention may contain one or more photoacid generators, sensitizers, reducing agents, adhesion promoting additives, water repellents, electromagnetic wave absorbing members and so on. Thermoplastic resin, softening point controlling resin, strength enhancing resin and so on may be added to the photosensitive resin. Furthermore, the photosensitive resin may contain one or more inorganic filler substances, carbon nanotubes and so on. Moreover, the photosensitive resin may contain an electro-conductive material as static electricity countermeasure.

Additionally, the protecting layer 4 or the flow path forming member 6 may be formed from a metal material, a semiconductor material, an insulating material and so on or a combination of any of them. Examples of materials that can be used to form the protecting layer 4 or the flow path forming member 6 include metal materials such as Al, Cu, Ni, Ti, Fe, Mn, Mo, Sn, Cr, Ca, Pt, Au, Ag, Pd, W, Be, Na, Co, Sc, Zn, Ga, V, Nb, Ir, Hf, Ta, Hg, Bi and Pb and mixtures and alloys of two or more of the above-listed ones. Examples of materials additionally include La, Ce, Nd and Sm and mixtures and alloys of two or more of the above-listed ones. Alternatively, SUS, which is a popular alloy or a metal glass material may be used. Additional examples of materials that can be used to form the protecting layer 4 or the flow path forming member 6 include oxides, nitrides, nitrogen oxides, carbides, fluorides and borides of the above-listed metals and mixtures of two or more of those compounds. The protecting layer 4 or the flow path forming member 6 may contain one or more semiconductor materials such as Si, Ge, SiC, GaAs, InAs, GaP, GaN, SiN and BN and/or one or more carbon materials such as diamond-like carbon, graphite, carbon nanotube and son on.

The protecting layer 4 and the flow path forming member 6 may have a single layer structure or a multilayer structure. Furthermore, the liquid ejection head may additionally include an adhesion layer for improving the adhesion between layers, between a layer and a member or between members, a flattening layer, an anti-reflection layer and/or a chemical-resistant layer. Any of these layers may be formed between two layers that the liquid ejection head properly includes. One or more devices including an integrated circuit and/or MEMS may be formed in the above-listed extra layers. While the ejection ports 7 are formed at the flow path forming member 6 in the liquid ejection head shown in FIG. 1, the configuration of the liquid ejection head is not limited to the one shown in FIG. 1. For example, as an additional member, an ejection port forming member may be bonded to the flow path forming member 6 having a flow path and the flow path 8 and the ejection ports 7 may be formed on the first surface 1-1 of the substrate 1.

First Embodiment

Now, the first embodiment of method of manufacturing a liquid ejection head according to the present invention will specifically be described below by referring to FIGS. 2A through 2F. In FIGS. 2A through 2F, the part of the liquid ejection head that corresponds to the cross section of A-A' in FIG. 1 is schematically illustrated.

Note that, in this embodiment, the surface of the substrate where ejection ports are arranged is referred to as the first surface and the surface opposite to the first surface is referred to as the second surface.

Figure 2A:
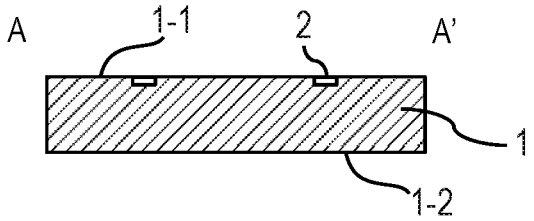
FIGS. 2A, 2B, 2C, 2D, 2E and 2F are a schematic illustration of an embodiment of method of manufacturing a liquid ejection head according to the present invention.

Firstly, a substrate in which energy generating elements are formed as shown in FIG. 2A is brought in. Then, protecting layer 4 is formed at least on the region of the first surface 1-1 of the substrate 1 that includes a part where a flow path 8 is to be formed (a protecting layer forming step). A layer forming technique that involves the use of a spin coating technique, a slit coating technique, a spray coating technique, a nano imprinting technique, a dipping technique, a dry film using technique or the like may be employed to form the protecting layer 4. Alternatively, a physical vapor deposition (PVD) technique that involves the use of sputtering, vacuum evaporation, molecular beam epitaxy, laser deposition, electron beam evaporation or the like may be used. Still alternatively, the protecting layer 4 may be formed by means of a chemical vapor deposition (CVD) technique that utilizes a chemical reaction such as atomic layer deposition (ALD), vapor deposition polymerization or the like. Heat, plasma, electromagnetic waves, one or more catalysts and so on may be used in combination for the CVD technique. Furthermore, any of the above-described film forming techniques may be combined to form the protecting layer 4. After forming the protecting layer, the protecting layer may be subjected to a treatment process using heat, electromagnetic waves, electron beams and/or plasma.

Figure 2B:
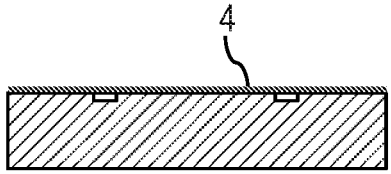
Figure 2C:
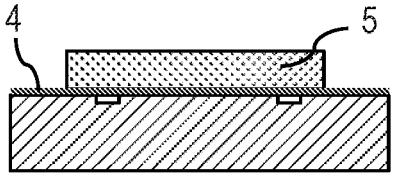

Then, a sacrificial layer 5 is formed on the protecting layer 4 as shown in FIG. 2C (a sacrificial layer forming step). The material to be used for forming the sacrificial layer is not subject to any particular limitations. The material may be selected from known materials for forming flow paths and materials that can be utilized to form sacrificial layers. Materials that can be used to from the sacrificial layer 5 include resin materials, metal materials, semiconductor materials, insulating materials and so on and any of these materials may be used in combination. Any of the above-described techniques for forming the protecting layer can also be used to form the sacrificial layer. For instance, after forming a layer of the material selected to form the sacrificial layer on the substrate, the sacrificial layer can be produced by processing that layer. For this processing operation, one or more techniques may be selected from heat treatment, luminous exposure, development, etching and so on depending on the type of the material selected to form the sacrificial layer.

If the protecting layer is to be subjected to an etching process or a flow path forming member is to be formed on the sacrificial layer in a later step, the angle formed between the lateral wall of the sacrificial layer and the substrate is preferably not greater than 90° C. The expression that the angle formed between the lateral wall of the sacrificial layer and the substrate means that the lateral wall of the sacrificial layer is so formed as to make the contact area of the sacrificial layer and the flow path forming member to be the same as or smaller than the contact area of the sacrificial layer and the substrate. The sacrificial layer may have a single layer structure or a multilayer structure.

Figure 2D:
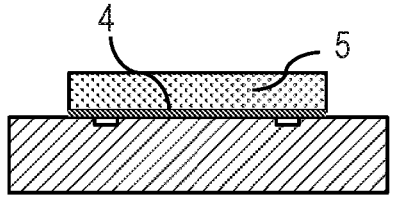

The protecting layer 4 is subjected to a patterning process by using the sacrificial layer 5 as mask as shown in FIG. 2D.

The technique to be used for the patterning process may be selected from chemical and physical techniques including wet etching, dry etching, electron beam processing, laser processing, sand blast processing and so on. Lithography may be used for the patterning process when the protecting layer 4 shows photosensitivity.

When lithography is employed for the patterning process, the sacrificial layer 5 is preferably formed by using a material that absorbs the electromagnetic waves or the electron beam to be irradiated onto the protecting layer 4 and hence can operate as mask. Using the sacrificial layer 5 as mask for patterning the protecting layer provides an advantage of improving the positioning accuracy between the protecting layer 4 and the flow path 8.

When wet etching is employed for the patterning process, a layer or a member for protecting the part or parts of the protecting layer other than the region to be removed of the protecting layer against wet etching needs to be arranged on the part or parts of the protecting layer by means of any of known materials and known techniques for arranging such a layer or a member.

An effect of maintaining the profile of the sacrificial layer and improving the positioning accuracy of the flow path to be formed in a later step can be obtained by using a large etch selectivity value relating to selectively removing the sacrificial layer and the protecting layer from the substrate in the patterning step. When, for example, etching is employed for the patterning process, the ratio of the etching rate of the sacrificial layer relative to the etching rate of the protecting layer is preferably used as etch selectivity.

An etch selectivity value not smaller than 2 is preferable from the viewpoint of pattern formation and the use of an etch selectivity value not smaller than 5 is preferable from the viewpoint of improving the accuracy of pattern formation, whereas the use of an etch selectivity value not smaller than 10 is more preferable from the viewpoint of further improving the accuracy of pattern formation. Selection of a technique of etching the protecting layer, using a liquid or gas that substantially does not damage the sacrificial layer will be more advantageous.

The smaller the ratio of the thickness of the protecting layer relative to the thickness of the sacrificial layer, the smaller the effect of adversely influencing the dimensional accuracy of the sacrificial layer and hence the greater the effect of raising the accuracy of the sacrificial layer. The ratio of the thickness of the protecting layer relative to the thickness of the sacrificial layer is preferably not more than 50%, more preferably not more than 25%, most preferably not more than 10%, provided that the protection feature of the protecting layer is secured.

The sacrificial layer 5 also operates as the mold material for the flow path. Note, however, a sacrificial layer that is not to be utilized as the mold material of the flow path may be arranged as mask on other than the part for forming the flow path. The protecting layer may be made to remain on the wiring section of the substrate by means of such a sacrificial layer in order to protect the wiring section of the substrate.

Figure 2E:
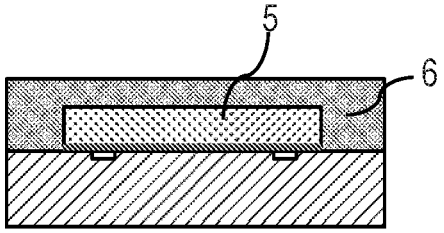

Then, the flow path forming member 6 for coating the sacrificial layer 5 is formed as shown in FIG. 2E (a sacrificial layer coating step). Any known appropriate technique may be used for forming the flow path forming member.

Figure 2F:
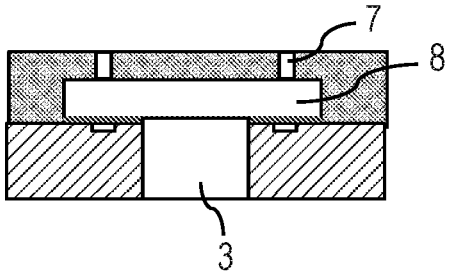

Additionally, the liquid supply path 3 that is a through hole running through the substrate 1 from the first surface 1-1 to the second surface 1-2 is formed in the substrate 1 (a liquid supply path forming step). The liquid supply path 3 is arranged so as to get to the sacrificial layer 5. More specifically, when the liquid supply path 3 is formed by etching, for example, the surface that is being etched gets to the sacrificial layer 5. Then, after the ejection ports 7 are formed through the flow path forming member 6, the sacrificial layer 5 operating as the mold material is removed from the surface of the substrate 1. As a result, the flow path 8 as shown in FIG. 2F is produced (a flow path forming step). The above-described steps can be executed respectively by means of known appropriate techniques. The route by which the sacrificial layer 5 is removed may appropriately be selected according to the configuration of the liquid ejection head. For example, the sacrificial layer may be removed by way of the liquid supply path 3 in a state where the ejection ports 7 are closed or, alternatively, the sacrificial layer may be removed by way of the liquid supply path 3 and the ejection ports 7 in a state where the ejection ports 7 are open.

Second Embodiment

Now the second embodiment of method of manufacturing a liquid ejection head according to the present invention will specifically be described below by referring to FIGS. 3A through 3F. The part of the liquid ejection head that corresponds to the cross section of A-A' in FIG. 1 is also schematically illustrated in FIGS. 3A through 3F.

Again, in the following description of this embodiment, the surface of the substrate at the side where the ejection ports are formed is referred to as the first surface and the surface opposite to the first surface is referred to as the second surface. Additionally, the materials and the techniques that are described above for the first embodiment can also be used for this embodiment.

Figure 3A:
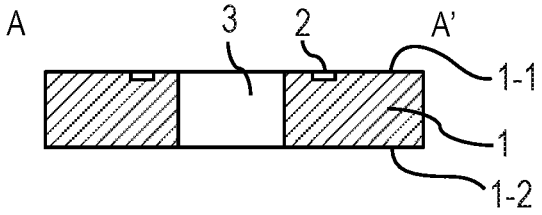
FIGS. 3A, 3B, 3C, 3D, 3E and 3F are a schematic illustration of another embodiment of method of manufacturing a liquid ejection head according to the present invention.
Figure 3B:
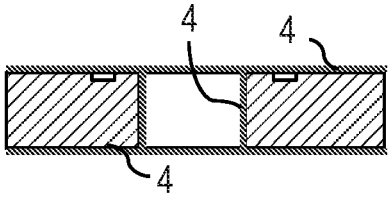

Firstly, as shown in FIGS. 3A and 3B, liquid supply path 3, which is a through hole running through the substrate 1 from the first surface 1-1 to the second surface 1-2, is formed and subsequently protecting layer 4 is formed. In this embodiment, the protecting layer can also be formed on the inner wall surface of the through hole that operates as the liquid supply path and on the second surface 1-2 of the substrate 1 to provide an advantage of improving the reliability of the liquid ejection head.

Figure 3C:
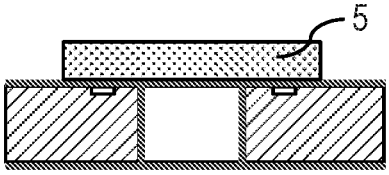

Then, as shown in FIG. 3C, sacrificial layer 5 is formed on the protecting layer 4. When forming the sacrificial layer, preferably, the area where the liquid supply path 3 is open is included in the surface where the sacrificial layer is to be formed and dry film is employed for forming the sacrificial layer 5. The use of dry film for forming the sacrificial layer 5 provides an advantage that the sacrificial layer 5 can highly accurately formed in a desired region on the first surface 1-1 of the substrate 1 that includes the area where the liquid supply path 3 is open.

Figure 3D:
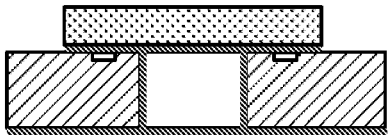
Figure 3E:
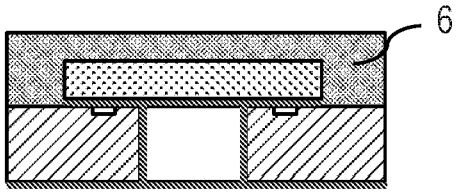
Figure 3F:
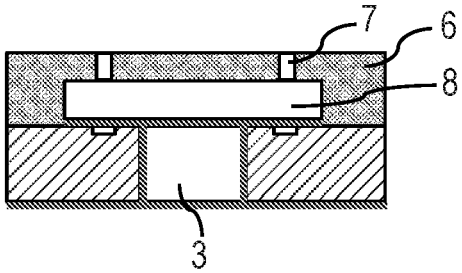

Thereafter, as shown in FIGS. 3D and 3E, the protecting layer 4 is subjected to a patterning operation, using the sacrificial layer 5 as mask and subsequently the sacrificial layer 5 is coated with the flow path forming member 6. Additionally, as shown in FIG. 3F, ejection ports 7 are formed through the flow path forming member 6 and then the sacrificial layer 5 that operates as mold material is removed from the corresponding surface of the substrate 1 to produce the flow path 8 there.

How the flow path 8 is produced on the first surface 1-1 of the substrate 1, where ejection ports 7 are arranged, by means of the first and second embodiments of method of manufacturing a liquid ejection head according to the present invention is described above. The above-described process of forming a flow path can also be used to form a flow path on the second surface 1-2 of the substrate 1.

Third Embodiment

Now, the third embodiment of method of manufacturing a liquid ejection head according to the present invention will be described below. With the third embodiment, etching is employed for patterning the protecting layer. As etching is employed, the oppositely disposed ends of the protecting layer that are produced by etching the protecting layer after the patterning process are made to show a forwardly tapered or backwardly tapered profile as viewed in the direction heading for the sacrificial layer from the substrate.

Figure 4A:
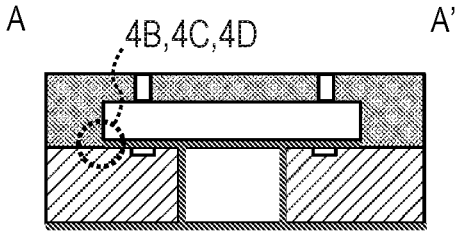
FIGS. 4A, 4B, 4C and 4D are a schematic illustration of a mode of bonding an end of the protecting layer and the flow path forming member after the patterning step of an embodiment of method of manufacturing a liquid ejection head according to the present invention.
Figure 4B:
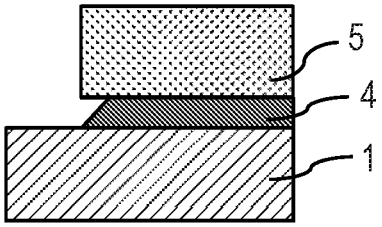
Figure 4C:
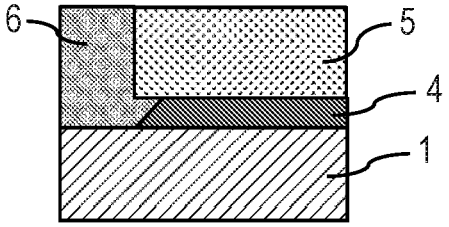
Figure 4D:
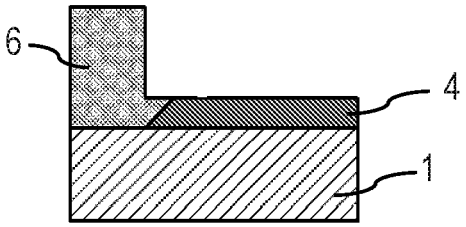
Figure 5A:
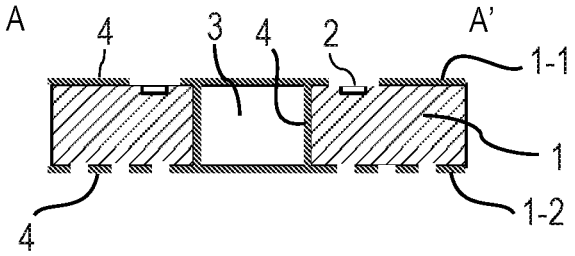
FIGS. 5A, 5B, 5C and 5D are a schematic illustration of still another embodiment of method of manufacturing a liquid ejection head according to the present invention.
Figure 5B:
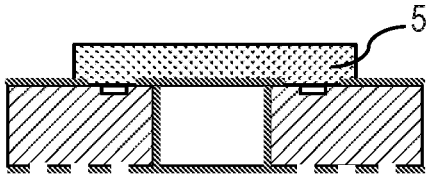
Figure 5C:
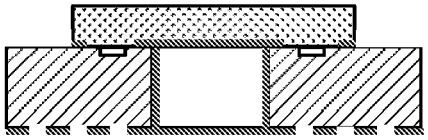
Figure 5D:
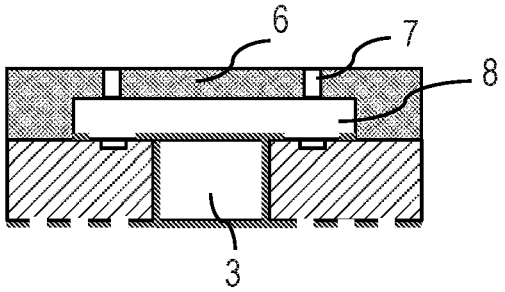

FIG. 4A shows the configuration of the liquid ejection head manufactured by way of the steps shown in FIGS. 3A through 3F. FIGS. 4B through 4D are enlarged schematic views of one of the end portions and its vicinity of the protecting layer on the way of getting to the profile of FIG. 4A.

As shown in FIG. 4B, the protecting layer 4 can be made to show forwardly tapered etched ends with an angle of smaller than 90° on the substrate 1 by etching the protecting layer 4, using the sacrificial layer 5 as mask. In other words, the oppositely disposed ends (etched ends) of the protecting layer 4 that are produced as a result of the etching process are made to show surfaces that are inclined continuously or stepwise so as to make the contact surface between the protecting layer 4 and the sacrificial layer 5 smaller than the contact surface between the protecting layer 4 and the first surface 1-1 of the substrate 1.

When the etched ends of the protecting layer are forwardly tapered, the protecting layer becomes less liable to be peeled off and/or chipped off to provide an advantage of improving the manufacturing yield.

The etching conditions for making the etched ends of the protecting layer forwardly tapered may appropriately be selected according to the intended tapered profile. For example, a forwardly tapered profile can accurately be formed by using two or more different layers to form the protecting layer 4 and presetting respective etching rates for those layers that are different from each other. If such is the case, the etching rates of the layers from the substrate to the sacrificial layer are made to forwardly increase, starting from the substrate. The taper angle can be controlled by way of the adhesiveness between the sacrificial layer and the protecting layer. When a thermosetting material is employed to form the sacrificial layer, the adhesiveness between the sacrificial layer and the protecting layer can be controlled by way of the baking temperature of the sacrificial layer. For instance, when a material that raises the adhesiveness between the sacrificial layer and the protecting layer as the baking temperature of the sacrificial layer is raised to make it difficult to taper the protecting layer is employed to form the sacrificial layer, the taper angle can be adjusted by way of the baking temperature. Additionally, the taper angle can be adjusted by executing a preprocessing operation using a silane coupling agent for improving the adhesiveness between the sacrificial layer and the protecting layer.

The combination of the material of the sacrificial layer and that of the protecting layer needs to be selected so as to prevent the sacrificial layer from disappearing during the process of etching the protecting layer. When the material of the sacrificial layer is a positive-type photosensitive resin material such as positive-type resist containing novolac resin or acrylic resin as principal ingredient, wet etching using an acid selected from fluoric acid, buffered fluoric acid, hydrochloric acid, nitric acid, sulfuric acid, acetic acid, phosphoric acid or the like or chemical or physical dry etching using fluorine, chlorine, oxygen, nitrogen, argon or the like can be employed for etching the protecting layer. When the material of the sacrificial layer is a positive-type photosensitive resin material as described above, resist dissolution can occur if KOH or tetramethylammonium hydroxide (TMAH), which is an alkali solution, or the like is employed. Therefore, if such is the case, cyclized rubber is preferably selected for the sacrificial layer.

The degree of freedom relative to selection of the type of etching for etching the protecting layer is raised when a negative-type photosensitive material such as negative-type resist containing epoxy resin or acrylic resin as principal ingredient or a resin material showing no photosensitivity such as polyamide, polyimide or polyetheramide is selected for the material for forming the sacrificial layer. Then, for example, wet etching using acid or alkali or chemical or physical dry etching can be used for etching the sacrificial layer. When the sacrificial layer is formed by using aluminum, a desired etch selectivity can easily be obtained by selecting a material that can be removed by fluorine-using dry etching such as dry etching using SiO, SiN, SiON, Ta, Mo, W or Ti to form the protecting layer. Besides, the materials for forming the protecting layer and the sacrificial layer can be selected by means of any of known techniques that are being used in the field of MEMS (micro electro mechanical systems).

The protecting layer can be prevented from being peeled off to provide an advantage of further improving the manufacturing yield by arranging the flow path forming member 6 so as to make it contact the etched ends of the protecting layer as shown in FIGS. 4C and 4D.

When, on the other hand, the etched ends of the protecting layer are backwardly tapered to make the taper angle exceed 90°, a structure that supports the protecting layer from under can be obtained by making the backwardly tapered etched ends of the protecting layer contact the flow path forming member 6. Then, as a result, the protecting layer becomes less liable to be chipped off to also provide an advantage of improving the manufacturing yield. The flow path forming member is preferably formed by using at least a technique selected from a wet process, a technique of using dry film, PVD and CVD in order to produce a good bonding effect between the etched ends of the protecting layer and the flow path forming member. When a wet process is employed, a coating solution containing photosensitive resin, which may be positive-type photosensitive resin or negative-type photosensitive resin, and a solvent is applied onto the substrate to form a coating layer. Then, the flow path forming member can be obtained typically by removing the solvent from the layer of the applied solution by means of an appropriate technique, which may typically be drying or some other technique, subsequently exposing the layer to light, using a mask, and then executing a development process, using a development solution. From the viewpoint of obtaining an even more excellent adhesiveness between the substrate and the etched ends of the protecting layer, the use of a wet process is preferable for forming the flow path forming member. If such is the case, the sacrificial layer is preferably formed by selecting a material that is not dissolvable in the solvent to be used in the wet process. If the sacrificial layer is dissolvable in the solvent to be used in the wet process, a technique of using dry film whose solvent content ratio is small and hence that adversely affects the sacrificial layer only to a small extent or a technique of using PVD or CVD may preferably be utilized to form the flow path forming member. Alternatively, after forming the part of the flow path forming member that covers the sacrificial layer by using one or more of the technique of using dry film and the technique of using PVD or CVD, the remaining part of the flow path forming member may be formed by way of a wet process. In such instance, the part of the flow path forming member that is formed in advance provides the effect of protecting the sacrificial layer and hence the process of forming the remaining part of the flow path forming member can be completed by way of a wet process without damaging the sacrificial layer.

When etching is employed for the operation of patterning the protecting layer, after etching the protecting layer, using the sacrificial layer as mask, grooves may additionally be formed by means of etching in the region of the substrate from which the protecting layer has been removed. When the substrate is a silicon substrate, grooves can be formed on the substrate by way of a Bosch process. By forming grooves, the contact area between the flow path forming member and the substrate can be increased at a later stage to provide an advantage of improving the adhesiveness between the substrate and the flow path forming member.

Fourth Embodiment

FIGS. 5A through 5D schematically illustrate the fourth embodiment of method of manufacturing a liquid ejection head according to the present invention.

In this embodiment, protecting layer 4 is selectively arranged on the parts of the first surface 1-1 of the substrate 1 that are exposed to the flow path and require protection and also on the parts of the second surface 1-2 of the substrate 1 that also require protection as shown in FIGS. 5A through 5D. This embodiment can be conducted just like the second embodiment as shown in FIGS. 3A through 3F except that the positional arrangement of the protecting layer is modified.

Partial formation of the protecting layer 4 typically corresponds to the formation of a functional film as anti-scorching measure and anti-cavitation measure. Such partial formation of the protecting layer can be realized by way of a process of forming a protecting layer 4 on the first surface 1-1 of the substrate 1 and subsequently patterning the protecting layer 4 by means of a known technique or by way of a process of forming a protecting layer 4 by means of PVD or CVD, using a mask for regulating the protecting layer forming areas.

Fifth Embodiment

Figure 6A:
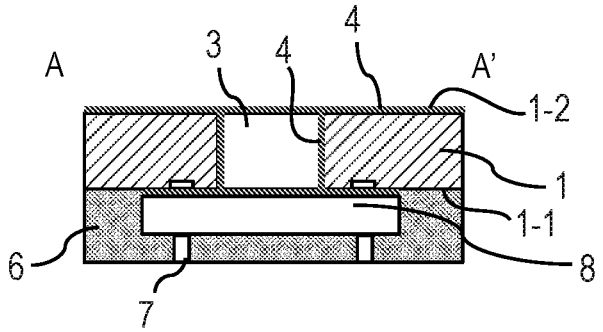
FIGS. 6A, 6B and 6C are schematic illustration of still another embodiment of method of manufacturing a liquid ejection head according to the present invention.
Figure 6B:
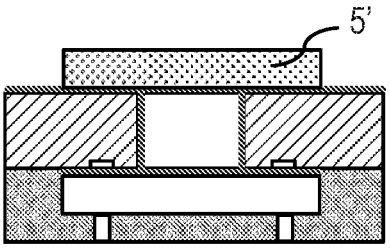
Figure 6C:
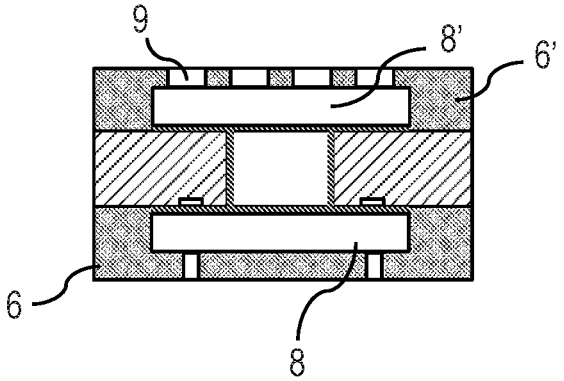

FIGS. 6A through 6C schematically illustrate the fifth embodiment of method of manufacturing a liquid ejection head according to the present invention.

The embodiment corresponds to the (2nd mode of combination of the first flow path forming step and the second flow path forming step), which is described earlier.

For this embodiment, the surface of the substrate where the ejection ports are formed is referred to as the first surface.

The materials and the methods described earlier for the first embodiment can also be used to form the second sacrificial layer and the second flow path forming member by this embodiment.

Firstly, as shown in FIG. 6A, the first flow path forming member 6 having ejection ports 7 and the first flow path 8 is formed at the side of the first surface 1-1 of the substrate 1 where the ejection ports are arranged. The second embodiment of the present invention as shown in FIGS. 3A through 3F can be utilized to form the flow path forming member 6.

Then, as shown in FIG. 6B, the second sacrificial layer 5' is formed on the second surface 1-2 of the substrate 1. Subsequently, after patterning the protecting layer 4, using the second sacrificial layer 5' as mask, the second flow path forming member is formed to cover the second sacrificial layer 5'. Then, the second sacrificial layer 5' is removed from the second surface 1-2 of the substrate 1 and the second flow path forming member 6' having the second flow path 8' as shown in FIG. 4C is formed.

The sacrificial layer 5' may be removed by way of the liquid supply path 3 and the openings 9 in a state where the ejection ports 7 are closed or, alternatively, by way of the liquid supply path 3, the openings 9 and the ejection ports 7 in a state where the ejection ports 7 are open.

The openings 9 that are formed in the second flow path forming member may be provided with a feature of operating as filter for preventing foreign objects from entering or may alternatively be used as connecting member to some other mounted member. Still alternatively, the openings 9 may be provided with a feature of controlling the flow resistance. Furthermore, if there are a plurality of rows of certain members in a single chip, the openings 9 may be provided with a feature of separating the rows. The shape, the size and the number of the openings 9 are not subject to limitations and openings of different shapes, sizes and numbers may coexist for a single through hole. Alternatively, openings of different shapes, sizes and numbers may coexist for a plurality of through holes in a single substrate.

When openings are formed at both of the surfaces of the substrate, they may be formed in any order. In other words, the openings of either of the surfaces may be formed first.

In each of the above-described embodiments, the protecting layer may be provided with a feature of operating as an identification symbol, which may be a number or an alignment mark. For example, an identification symbol can be formed by the protecting layer by patterning the protecting layer, using the sacrificial layer as mask, so as to keep the protecting layer existing for the identification symbol in an area other than the flow path, where an identification symbol is to be arranged.

Additionally, the sacrificial layer may be provided with a feature of operating as an identification symbol, which may be a number or an alignment mark. For example, the sacrificial layer that has been patterned for such an identification symbol may be arranged in an area other than the flow paths where an identification symbol is to be arranged and then the sacrificial layer may be coated with the flow path forming member so as to be included in the flow path forming member without being removed from the substrate.

Then, with the above-described process, an identification symbol can be arranged (displayed) by means of the sacrificial layer.

A liquid ejection system can be established by using a liquid ejection head manufactured by a manufacturing method according to the present invention. A liquid ejection system may be an apparatus such as a printer, a copying machine, a fax machine having a communication system, a word processor having a printer section, a portable apparatus or an industrial apparatus where a liquid ejection head is combined with various processing devices in a compositive manner. The target to which liquid is to be ejected may be a two-dimensional structure, a three-dimensional structure or a space. Furthermore, such a liquid ejection system can be applied to a semiconductor manufacturing apparatus, a medical apparatus or a figurative apparatus such as a 3D printer.

EXAMPLES

Now, a method of manufacturing a liquid ejection head according to the present invention will be described further in greater detail by way of examples. Note, however, the examples that are described below do not limit the scope of the present invention by any means.

Example 1

Energy generating elements 2 that were made of TaSiN were formed on a silicon-made substrate 1 as shown in FIG. 2A. Then, a 400-nm-thick SiCN-made layer was formed by means of plasma CVD and then a 50-nm-thick Ta-made layer was formed thereon by means of sputtering to produce a protecting layer 4 as shown in FIG. 2B. Thereafter, positive-type photosensitive resin (ODUR1010: trade name, available from Tokyo Ohka Kogyo) was applied to the surface of the substrate 1 to a thickness of 20 μm for a sacrificial layer and the applied positive-type photosensitive resin was site-selectively exposed to light by using a stepper (FPA-3000i5+: trade name, available from Canon) and then subjected to a development process to form a sacrificial layer 5 as shown in FIG. 2C.

Then, the protecting layer 4 that was made of SiCN and Ta was subjected to a dry etching process, using $CF_4$, $O_2$ and $N_2$ as etching gas and also using the sacrificial layer 5 as mask as shown in FIG. 2D.

Thereafter, a flow path forming member 6 was formed to cover the sacrificial layer 5 as shown in FIG. 2E. The flow path forming member 6 was formed in a manner as described below.

Negative-type photosensitive resin (EHPE-3150: trade name, available from Daicel Corporation) was applied to the surface of the substrate 1 on which the sacrificial layer 5 had been formed so as to obtain a desired thickness for the flow path forming member and the applied layer was subjected to a back side rinse and lateral side rinse operation. Subsequently, the applied layer was baked on a hot plate. Additionally, fluorine-based resin was applied to the surface of the applied layer by means of slit coating and baked on a hot plate to obtain the flow path forming member 6.

Then, the flow path forming member 6 was site-selectively exposed to light by using the above-described stepper and then subjected to a development process to produce ejection ports 7. Thereafter, the flow path forming member 6 was baked on a hot plate. Subsequently, the flow path forming member 6 was protected by cyclized rubber and a through hole that was to become the liquid supply path 3 later was formed through the substrate 1 by means of laser processing and anisotropic etching, using TMAH aqueous solution. The through hole was made to get to the sacrificial layer 5 by dry etching the protecting layer 4 by way of the liquid supply path 3, using $CF_4$, $O_2$ and $N_2$ as etching gas. Thereafter, the cyclized rubber and the sacrificial layer 5 were removed from the substrate 1 by means of xylene and methyl lactate to obtain the flow path 8 as shown in FIG. 2F.

Thus, the liquid ejection head of this example was manufactured in the above-described manner.

Example 2

Energy generating elements 2 that were made of TaSiN were formed on a silicon-made substrate 1 as shown in FIG. 2A. Then, a 200-nm-thick Ta layer was formed as protecting layer 4 by means of sputtering as shown in FIG. 2B. Thereafter, polyimide (PI2611: trade name, available from HD Microsystems) was applied by spin coating onto the protecting layer 4 and dehydrated/condensed in an oven to arrange a polyimide layer as a sacrificial layer on the substrate shown in FIG. 2C. Then, positive-type photosensitive photoresist was applied onto the polyimide layer and the photoresist was subjected to a patterning operation so as to make it show a desired pattern in order to produce a mask for the coming patterning operation. Then, the polyimide layer was subjected to a patterning operation, using the mask for the patterning operation, by means of reactive ion etching based mainly on oxygen and subsequently the mask was peeled off to obtain the sacrificial layer 5.

Then, the protecting layer 4 was subjected to a dry etching operation, using $CF_4$, $O_2$ and $N_2$ as etching gas and also using the sacrificial layer 5 as mask as shown in FIG. 2D.

Thereafter, a flow path forming member 6 was formed to cover the sacrificial layer 5. More specifically, an SiON-made layer was formed by means of CVD for the flow path forming member 6 as shown in FIG. 2E. Then, a through hole that operates as the liquid supply path 3 was formed through the substrate 1 by way of a Bosch process, using a resist mask, as shown in FIG. 2F. Subsequently, ejection ports 7 were formed through the flow path forming member 6 and the sacrificial layer 5 was removed by means of chemical dry etching, using oxygen as principal ingredient, and by way of the liquid supply path 3 to produce the flow path 8.

Thus, the liquid ejection head of this example was manufactured in the above-described manner.

Example 3

A through hole that operates as the liquid supply path 3 was formed through a silicon-made substrate 1 having TaSiN-made energy generating elements 2 as shown in FIG. 3A as in Example 2. Then, a 200-nm-thick SiO layer and a 100-nm-thick AlO layer were formed in the above mentioned order for the protecting layer 4 by means of ALD as shown in FIG. 3B. Subsequently, positive-type photosensitive resin (ODUR1010: trade name, available from Tokyo Ohka Kogyo) that had been turned to a 10-μm-thick dry film was transferred onto the surface of the substrate 1 for the sacrificial layer. Additionally, the transferred dry film was site-selectively exposed to light by means of a stepper (FPA-3000i5+: trade name, available from Canon) and then subjected to a development process to obtain the sacrificial layer 5 as shown in FIG. 3C. Then, the protecting layer 4 was subjected to a wet etching process, using the sacrificial layer 5 as mask and also using buffered fluoric acid, as shown in FIG. 3D.

Subsequently, a dry film containing negative-type photosensitive resin (157S70: trade name, available from Mitsubishi Chemical) as principal ingredient was formed for the flow path forming member and transferred so as to cover the sacrificial layer 5 as shown in FIG. 3E. Additionally, fluorine-based resin was applied to the surface of the transferred dry film by means of slit coating and baked on a hot plate to obtain the flow path forming member 6. Then, the flow path forming member 6 was site-selectively exposed to light by means of the above-described stepper, subjected to a development process to form ejection ports 7 and then baked in an oven. Thereafter, the sacrificial layer 5 was peeled off and baked in an oven to produce the flow path 8 as shown in FIG. 3F.

Thus, the liquid ejection head of this example was manufactured in the above-described manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-119876, filed Jun. 19, 2017, which is hereby incorporated by reference herein in its entirety.

What is claimed is:

1. A method of manufacturing a liquid ejection head comprising a substrate having a surface provided with energy generating elements for ejecting liquid and a flow path forming member coupled with the substrate to form a flow path on the surface so as to eject liquid supplied to the flow path by means of energy generated by the energy generating elements, a protecting layer being arranged on a part of the surface exposed to the flow path, the method comprising:

a protecting layer forming step of forming the protecting layer in a region of the surface including the part thereof exposed to the flow path;

a sacrificial layer forming step of forming a sacrificial layer operating as a mold material for the flow path on the protecting layer;

a patterning step of patterning the protecting layer, using the sacrificial layer as a mask;

a sacrificial layer coating step of coating the sacrificial layer with a material for forming the flow path forming member;

a flow path forming step of forming the flow path by removing the sacrificial layer; and a liquid supply path forming step of forming a liquid supply path that runs through the substrate in a thickness direction of the substrate at a position where the liquid supply path communicates with the flow path of the substrate, wherein the liquid supply path forming step is before the protecting layer forming step, and the protecting layer is formed on the inner wall surfaces of the liquid supply path in the protecting layer forming step, and wherein the sacrificial layer is removed in the flow path forming step by way of the liquid supply path.

2. The method according to claim 1, wherein the surface includes a first surface where the ejection ports are arranged and a second surface that is a back surface opposite to the first surface and the flow path is formed on the first surface.

3. The method according to claim 1, wherein the surface includes a first surface where the ejection ports are arranged and a second surface that is a back surface opposite to the first surface and the flow path is formed on the second surface.

4. The method according to claim 1, wherein the sacrificial layer is formed by means of a dry film.

5. The method according to claim 1, wherein, after the pattering step, an end of the protecting layer and the flow path forming member are bonded in the sacrificial layer coating step.

6. The method according to claim 1, wherein the flow path forming member is formed by means of at least a method selected from a method that uses a dry film, a physical vapor deposition (PVD) method, and a chemical vapor deposition (CVD) method.

7. A method of manufacturing a liquid ejection head comprising a substrate having a surface provided with energy generating elements for ejecting liquid and a flow path forming member coupled with the substrate to form a flow path on the surface so as to eject liquid supplied to the flow path by means of energy generated by the energy generating elements, a protecting layer being arranged on a part of the surface exposed to the flow path, the method comprising:

a protecting layer forming step of forming the protecting layer in a region of the surface including the part thereof exposed to the flow path;

a sacrificial layer forming step of forming a sacrificial layer operating as a mold material for the flow path on the protecting layer;

a patterning step of patterning the protecting layer, using the sacrificial layer as a mask;

a sacrificial layer coating step of coating the sacrificial layer with a material for forming the flow path forming member; and a flow path forming step of forming the flow path by removing the sacrificial layer, wherein the patterning step is executed by means of etching, and wherein an end of the protecting layer produced as a result of the etching is forwardly or backwardly tapered from the substrate toward the sacrificial layer.

8. The method according to claim 7, wherein the protecting layer consists of two or more layers whose etching rates differ from each other.

9. The method according to claim 7, further comprising:

a liquid supply path forming step of forming a liquid supply path that runs through the substrate in a thickness direction of the substrate at a position where the liquid supply path communicates with the flow path of the substrate, wherein the sacrificial layer is removed in the flow path forming step by way of the liquid supply path.

10. The method according to claim 9, wherein the liquid supply path forming step is after the sacrificial layer coating step, and the liquid supply path is arranged so as to get to the sacrificial layer in the liquid supply path forming step.

11. The method according to claim 9, wherein the liquid supply path forming step is before the protecting layer forming step, and the protecting layer is formed on the inner wall surfaces of the liquid supply path in the protecting layer forming step.

12. The method according to claim 7, wherein the surface includes a first surface where the ejection ports are arranged and a second surface that is a back surface opposite to the first surface and the flow path is formed on the first surface.

13. The method according to claim 7, wherein the surface includes a first surface where the ejection ports are arranged and a second surface that is a back surface opposite to the first surface and the flow path is formed on the second surface.

14. The method according to claim 7, wherein the sacrificial layer is formed by means of a dry film.

15. The method according to claim 7, wherein, after the pattering step, an end of the protecting layer and the flow path forming member are bonded in the sacrificial layer coating step.

16. The method according to claim 7, wherein the flow path forming member is formed by means of at least a method selected from a method that uses a dry film, a physical vapor deposition (PVD) method, and a chemical vapor deposition (CVD) method.

* * * * *